US008369721B2

(12) United States Patent
Yamada

(10) Patent No.: US 8,369,721 B2
(45) Date of Patent: Feb. 5, 2013

(54) IMAGE OUTPUT APPARATUS HAVING POWER SAVING MODES

(75) Inventor: Akihiro Yamada, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 444 days.

(21) Appl. No.: 12/646,238

(22) Filed: Dec. 23, 2009

(65) Prior Publication Data

US 2010/0166442 A1 Jul. 1, 2010

(30) Foreign Application Priority Data

Dec. 26, 2008 (JP) ..... 2008-333819

(51) Int. Cl.
*G03G 15/00* (2006.01)

(52) U.S. Cl. ..... 399/37; 399/88

(58) Field of Classification Search ..... 399/37, 399/43, 82, 85, 88; 713/320, 324, 330, 340
See application file for complete search history.

(56) References Cited

U.S. PATENT DOCUMENTS

| | | | | |
|---|---|---|---|---|
| 5,697,717 | A | 12/1997 | Kaneko et al. | |
| 6,408,149 | B1 | 6/2002 | Taira et al. | |
| 7,265,852 | B2 * | 9/2007 | Goto et al. | 358/1.14 |
| 7,360,106 | B2 * | 4/2008 | Kato et al. | 713/323 |
| 7,565,086 | B2 * | 7/2009 | Tsujimura | 399/37 |
| 8,078,888 | B2 * | 12/2011 | Kumakura | 713/300 |
| 2002/0140964 | A1 | 10/2002 | Goto et al. | |

FOREIGN PATENT DOCUMENTS

| | | | | |
|---|---|---|---|---|
| JP | 6-316115 | | | 11/1994 |
| JP | 10-336400 | | | 12/1998 |
| JP | 2000-349948 | | | 12/2000 |
| JP | 2002-127553 | | | 5/2002 |
| JP | 2002-292977 | | | 10/2002 |
| JP | 2004-4296 | | | 1/2004 |
| JP | 2006159844 | A | * | 6/2006 |
| JP | 2006-301260 | | | 11/2006 |
| JP | 2008058393 | A | * | 3/2008 |
| JP | 2008166908 | A | * | 7/2008 |
| JP | 2008-211312 | | | 9/2008 |
| JP | 2008-211712 | | | 9/2008 |
| JP | 2008211712 | A | * | 9/2008 |

OTHER PUBLICATIONS

Japanese Official Action dated Apr. 5, 2011 together with an English language translation from JP 2008-333819.
Japanese Official Action dated Nov. 9, 2010 with English language transation.

* cited by examiner

*Primary Examiner* — Robert Beatty
(74) *Attorney, Agent, or Firm* — Scully, Scott, Murphy & Presser, PC

(57) ABSTRACT

An image output apparatus, which outputs an image on a recording medium, and which is activated in an activation mode including a first activation mode and a second activation mode that consumes less power than the first activation mode, the image output apparatus including: a switching unit that selects one of the first activation mode and the second activation mode as the activation mode for activating the image output apparatus; and a storage unit that stores a total amount of power consumed on and after a reference time. The switching unit switches the activation mode from the first activation mode to the second activation mode when the amount of total power consumption stored in the storage unit is equal to or more than a first threshold value.

10 Claims, 15 Drawing Sheets

| PRINT MODE | EXPLANATION OF MODES | DISPLAY | PRINT SPEED | FIXING TEMPERATURE | EXECUTION OF PRINTING | AVERAGE PER-SHEET POWER CONSUMPTION (Wh/SHEET) | MODE SHIFTING VALUE BY TOTAL AMOUNT OF POWER CONSUMPTION ON AND AFTER REFERENCE TIME |
|---|---|---|---|---|---|---|---|
| NORMAL PRINT MODE | NORMAL PRINT IN WHICH ENERGY-SAVING IS NOT OPERATED | ON | NORMAL | NORMAL | O | 4.0 | - |
| ENERGY-SAVING MODE 1 | PRINT WHEN NEITHER LIGHTING LED NOR DISPLAYING LCD | OFF | NORMAL | NORMAL | O | 3.7 | T1: 300Wh (T5-200) |
| ENERGY-SAVING MODE 2 | BESIDES ENERGY-SAVING MODE 1, PRINT AT HALF SPEED | OFF | LOW (50%) | NORMAL | O | 3.0 | T2: 350Wh (T5-150) |
| ENERGY-SAVING MODE 3 | BESIDES ENERGY-SAVING MODE 2, PRINT BY DECREASING FIXING TEMPERATURE BY 10°C | OFF | LOW (50%) | LOW (NORMAL-10°C) | O | 2.0 | T3: 400Wh (T5-100) |
| ENERGY-SAVING MODE 4 | BESIDES ENERGY-SAVING MODE 3, PRINT BY DECREASING FIXING TEMPERATURE BY 20°C | OFF | LOW (50%) | LOW (NORMAL-20°C) | O | 1.8 | T4: 450Wh (T5-50) |
| PRINTING PROHIBITION MODE | UNABLE TO PRINT | OFF | - | - | X | - | T5: 500Wh |

FIG. 2

| PRINT MODE | EXPLANATION OF MODES | DISPLAY | PRINT SPEED | FIXING TEMPERATURE | EXECUTION OF PRINTING | AVERAGE PER-SHEET POWER CONSUMPTION (Wh/SHEET) | MODE SHIFTING VALUE BY TOTAL AMOUNT OF POWER CONSUMPTION ON AND AFTER REFERENCE TIME |
|---|---|---|---|---|---|---|---|
| NORMAL PRINT MODE | NORMAL PRINT IN WHICH ENERGY-SAVING IS NOT OPERATED | ON | NORMAL | NORMAL | O | 4.0 | - |
| ENERGY-SAVING MODE 1 | PRINT WHEN NEITHER LIGHTING LED NOR DISPLAYING LCD | OFF | NORMAL | NORMAL | O | 3.7 | T1: 300Wh (T5-200) |
| ENERGY-SAVING MODE 2 | BESIDES ENERGY-SAVING MODE 1, PRINT AT HALF SPEED | OFF | LOW (50%) | NORMAL | O | 3.0 | T2: 350Wh (T5-150) |
| ENERGY-SAVING MODE 3 | BESIDES ENERGY-SAVING MODE 2, PRINT BY DECREASING FIXING TEMPERATURE BY 10°C | OFF | LOW (50%) | LOW (NORMAL-10°C) | O | 2.0 | T3: 400Wh (T5-100) |
| ENERGY-SAVING MODE 4 | BESIDES ENERGY-SAVING MODE 3, PRINT BY DECREASING FIXING TEMPERATURE BY 20°C | OFF | LOW (50%) | LOW (NORMAL-20°C) | O | 1.8 | T4: 450Wh (T5-50) |
| PRINTING PROHIBITION MODE | UNABLE TO PRINT | OFF | - | - | X | - | T5: 500Wh |

(CONT.)

(FIG. 3 CONTINUED.)
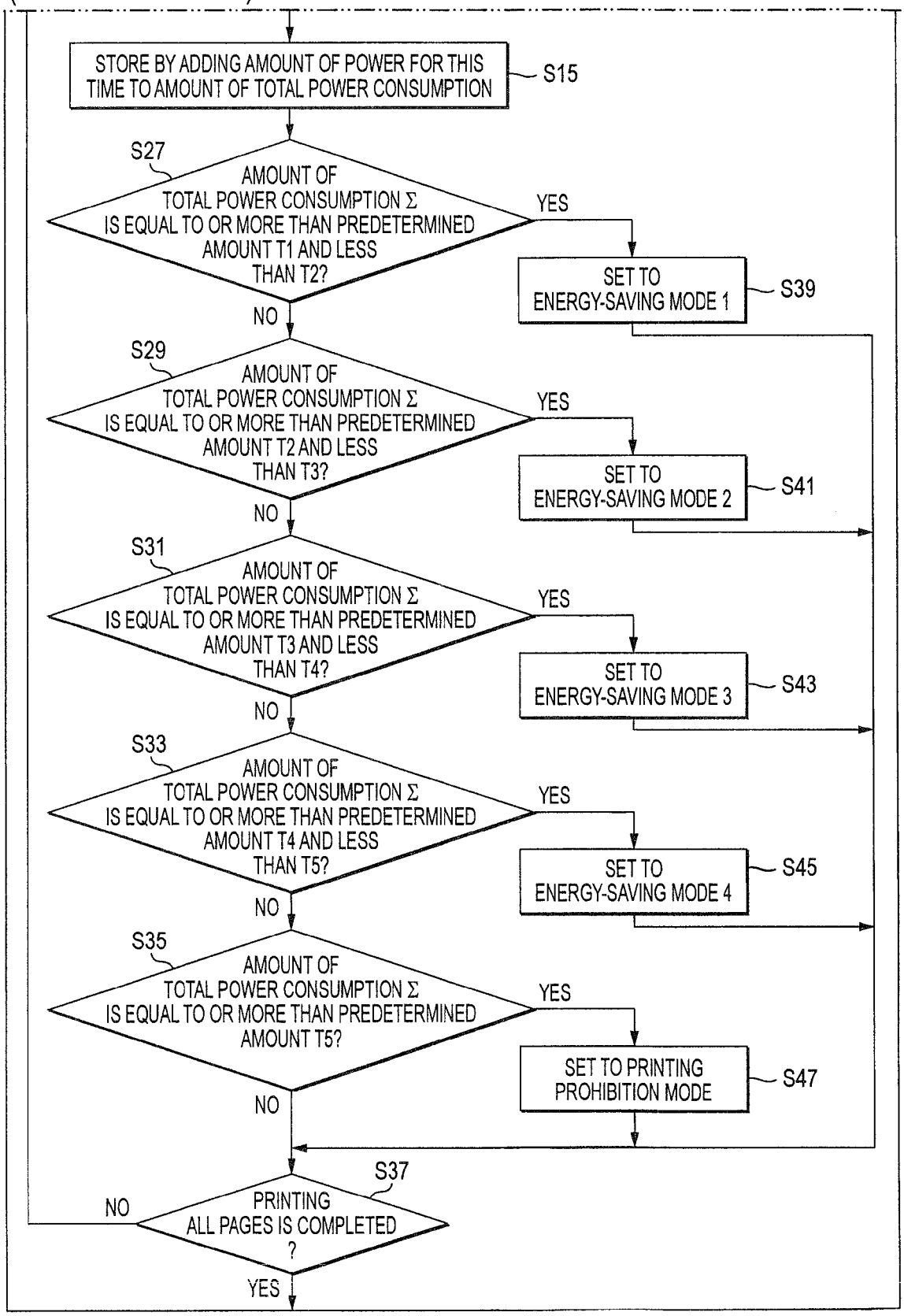

FIG. 4

Print limit is reached.
Not able to print any more.

(CONT.)

(FIG. 5 CONTINUED)
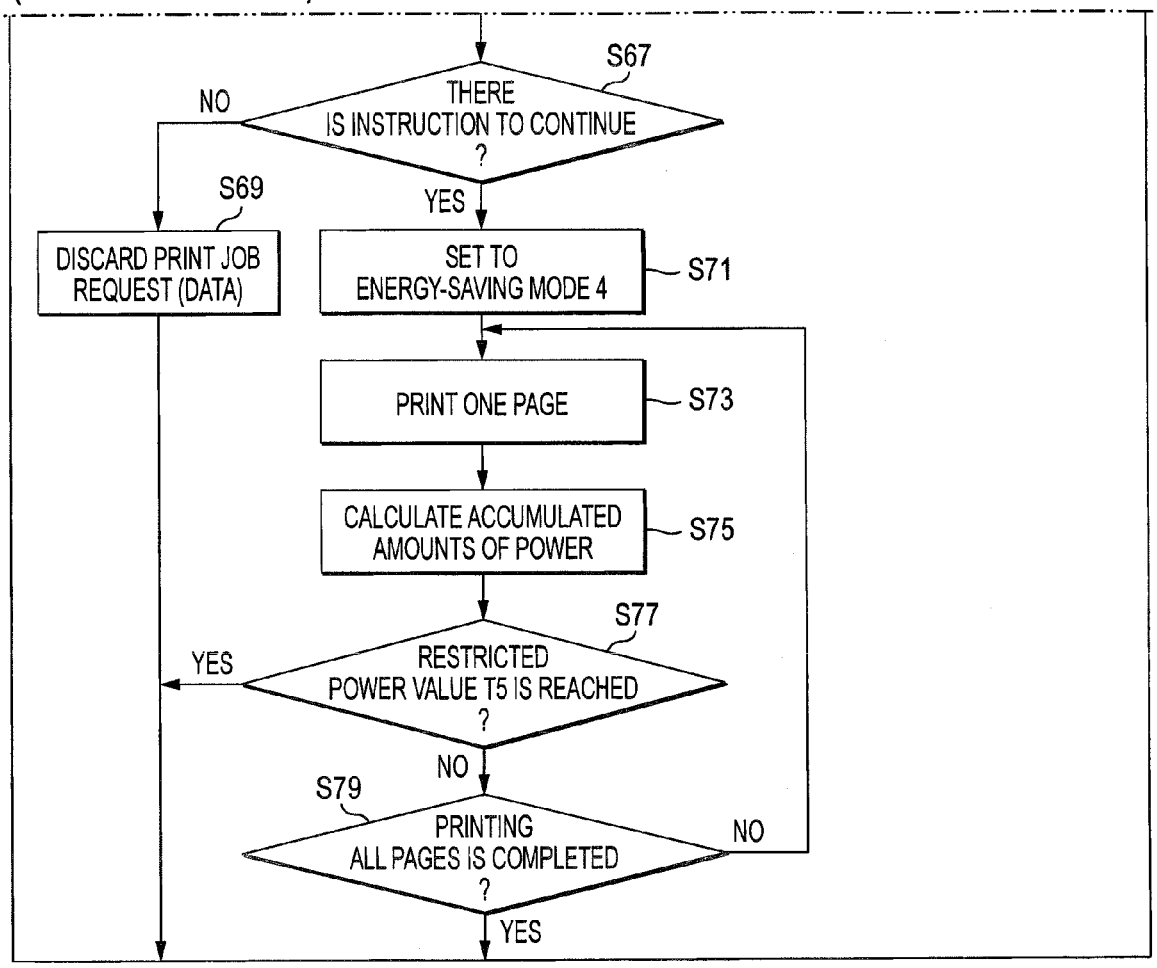

FIG. 6

Job may not be completed. Continue?
1. Yes 2. No (CONT.)

(FIG. 7 CONTINUED)
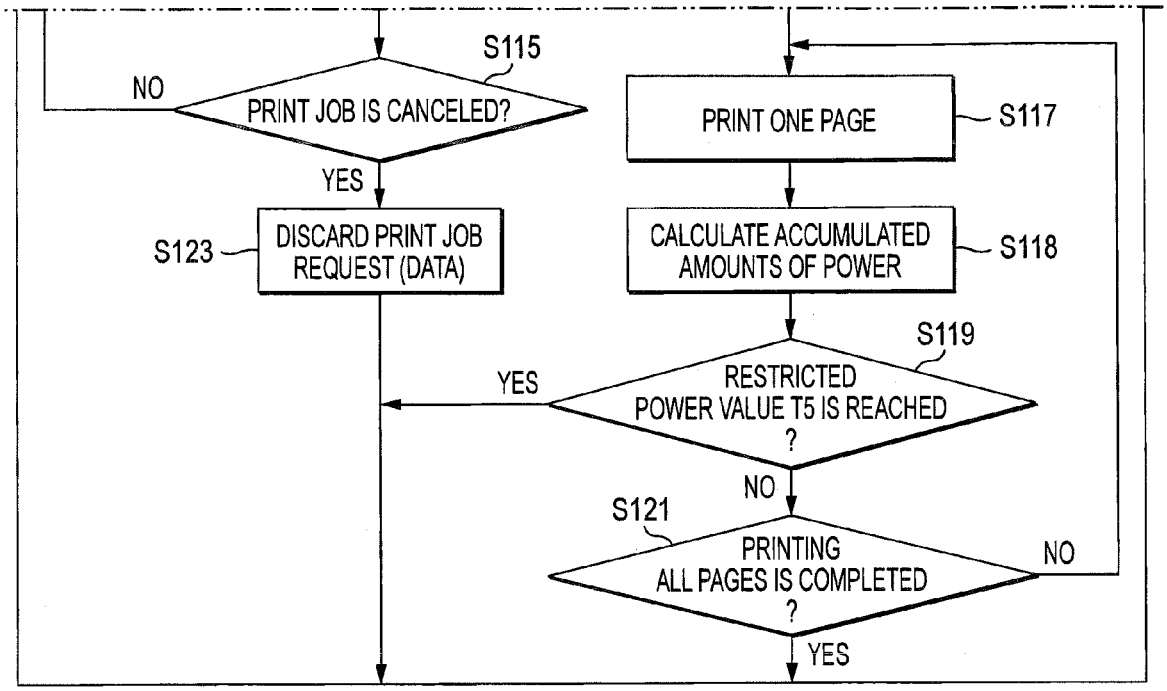

FIG. 8

Estimated number of printable pages
Normal print mode: 50 pages
Energy-saving mode 1: 60 pages
Energy-saving mode 2: 70 pages
Energy-saving mode 3: 80 pages
Energy-saving mode 4: 85 pages

FIG. 9

Select mode
1. Normal print mode
2. Energy-saving mode 1
3. Energy-saving mode 2
4. Energy-saving mode 3
5. Energy-saving mode 4
6. Cancel (FIG. 10 CONTINUED.)
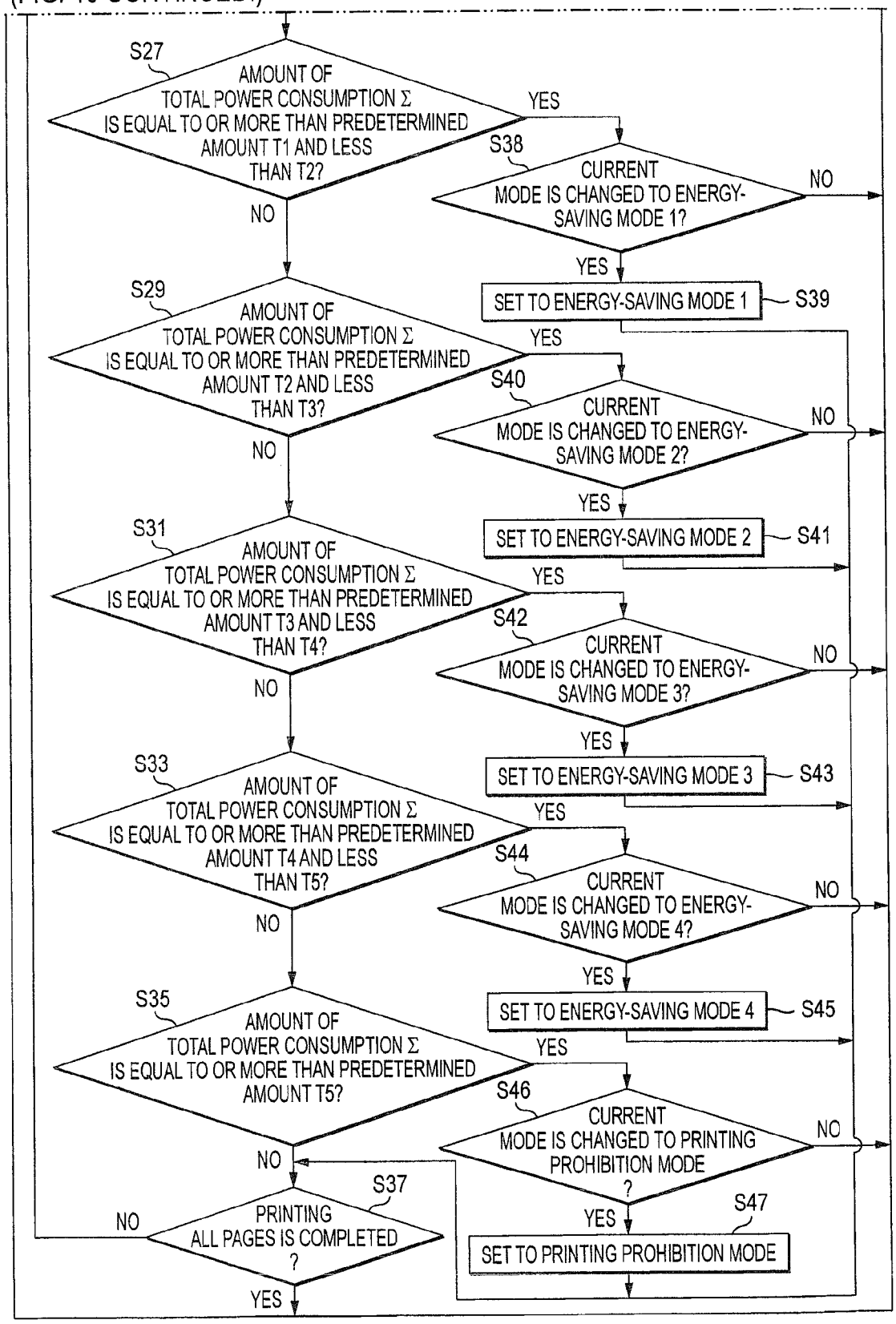

FIG. 11

| USER | RESTRICTED POWER VALUE (T5) | CURRENT TOTAL AMOUNT OF POWER TO BE USED |
|---|---|---|
| User1 | 500Wh | 100Wh |
| User2 | 600Wh | 150Wh |
| User3 | 550Wh | 55Wh |
| User4 | 700Wh | 350Wh |

IMAGE OUTPUT APPARATUS HAVING POWER SAVING MODES

CROSS-REFERENCE TO RELATED APPLICATIONS

This application claims priority from Japanese Patent Application No. 2008-333819 filed on Dec. 26, 2008, the entire subject matter of which is incorporated herein by reference.

TECHNICAL FIELD

The invention relates to an image output apparatus, and is effectively applied to an image output apparatus including a printing unit such as a printer, a copier, etc., which forms an image on a recording medium, or an image output apparatus that reads a document and outputs an image of the document as electronic data, for example.

BACKGROUND

There has been proposed a known copier which, when power momentarily used (i.e., maximum value of power consumption) exceeds a predetermined value during driving of the copier, activates in a low-speed print mode in order to suppress an increase in an amount of power consumption of the copier.

SUMMARY

Illustrative aspects of the invention provide an image output apparatus that can suppress an increase in an amount of power consumption of the output apparatus.

The known copier is activated in a low-speed print mode when the maximum value of the power consumption, which is changed moment by moment, exceeds the predetermined value. Thus, when the copier is continuously driven in a state where the maximum value of the power consumption is less than the predetermined value, the copier continues to drive without being shifted to the low-speed print mode.

That is, an amount of power consumption of the known copier increases along with an elapse of driving. Thus, it is difficult to reduce an amount of total power consumption of the known copier.

Therefore, illustrative aspects of the invention provide an image output apparatus that can suppress an increase in an amount of power consumption of the image output apparatus.

According to a first illustrative aspect of the invention, there is provided an image output apparatus, which outputs an image on a recording medium, and which is activated in an activation mode including a first activation mode and a second activation mode that consumes less power than the first activation mode, the image output apparatus comprising: a switching unit that selects one of the first activation mode and the second activation mode as the activation mode for activating the image output apparatus; and a storage unit that stores a total amount of power consumed on and after a reference time, wherein the switching unit switches the activation mode from the first activation mode to the second activation mode when the amount of total power consumption stored in the storage unit is equal to or more than a first threshold value.

According thereto, when the amount of power consumption of the image output apparatus on and after a reference time (i.e., an amount of total power consumption) is equal to or more than the first threshold value, the apparatus is driven in the second activation mode in which the power consumption is small. Therefore, it is possible to suppress an increase in the amount of power consumption of the image output apparatus.

According to a second illustrative aspect of the invention, the image output apparatus further comprises: a printing unit that prints an image on the recording medium, wherein the switching unit switches the activation mode from the first activation mode to the second activation mode when the amount of total power consumption becomes equal to or more than the first threshold value during printing the image by the printing unit.

According thereto, it is possible to suppress the increase in the amount of power consumption of the image output apparatus reliably.

According to a third illustrative aspect of the invention, the image output apparatus further comprises: a printing unit that prints an image on the recording medium based on a print job; and a determining unit that determines whether it is possible to complete the print job in the first activation mode, wherein the switching unit switches the activation mode from the first activation mode to the second activation mode if the determining unit determines that it is not possible to complete the print job in the first activation mode.

According thereto, if it is determined that completing the print job in the first activation mode is not possible, the activation modes are switched before the print job is executed. Therefore, it is possible to suppress an increase in the amount of power consumption of the image output apparatus reliably without the activation modes being switched during processing of the print job.

According to a fourth illustrative aspect of the invention, in the image output apparatus, wherein the printing unit comprises an exposure unit, a transfer unit and a heating and fixing unit so as to print the image electrophotographically, and wherein, in the second activation mode, the heating unit is activated at a heating temperature lower than that in the first activation mode.

Generally, in an image output apparatus that forms an image electrophotographycally, the heating and fixing unit occupies a large proportion in the power consumption. In this regard, according to the fourth illustrative aspect, in the second activation mode, activation is performed at a heating temperature lower than that in the first activation mode. Therefore, it is possible to suppress the increase in the amount of power consumption effectively.

Incidentally, as described above, by lowering the heating temperature of the heating and fixing unit, it is possible to suppress the power consumption effectively. However, if the heating temperature is excessively lowered, print quality may be deteriorated.

Therefore, according to a fifth illustrative aspect of the invention, in the image output apparatus, wherein the activation mode further includes a third activation mode in which the heating unit is heated at a heating temperature lower than that in the second activation mode, and wherein the switching unit switches the activation mode from the second activation mode to the third activation mode when the amount of total power consumption is equal to or more than a second threshold value larger than the first threshold value.

According thereto, the heating temperature is decreased in a stepwise manner. Therefore, it is possible to suppress the increase in the amount of power consumption effectively while preventing the print quality from being deteriorated.

According to a sixth illustrative aspect of the invention, in the image output apparatus, wherein, in the second activation mode, a conveyance speed of the recording medium is smaller than that in the first activation mode.

Incidentally, the recording medium according to the invention includes at least a recording sheet, on which an image is to be printed and a document conveyed by an automatic document feeder (ADF) of a copier or an image reader (scanner).

According to a seventh illustrative aspect of the invention, the image output apparatus further comprises: a printing unit that prints the image on the recording medium while conveying the recording medium, wherein, in the second activation mode, a conveyance speed of the recording medium is slower than that in the first activation mode.

According thereto, the power consumed by the conveyance of the recording sheet can be reduced.

According to an eighth illustrative aspect of the invention, the image output apparatus further comprises: a display unit that notifies a user of information, wherein, in the second activation mode, power supply to the display unit is stopped or reduced.

Incidentally, the display unit does not directly affect execution of outputting an image. Therefore, even if power supply to the display unit is stopped or reduced, the quality of an output image will not be adversely affected. Therefore, according to the eighth illustrative aspect, it is possible to suppress the increase in the amount of power consumption without adversely affecting the quality of the image.

According to a ninth illustrative aspect of the invention, the image output apparatus further comprises: a printing unit comprising an exposure unit, a transfer unit and a heating and fixing unit so as to print the image on the recording medium electrophotographycally, wherein the activation mode further includes a third activation mode in which the heating unit is heated at a heating temperature lower than that in the second activation mode, and wherein the switching unit switches the activation mode from the second activation mode to the third activation mode when the amount of total power consumption is equal to or more than a second threshold value larger than the first threshold value.

According thereto, if the amount of total power consumption is equal to or more than the first threshold value, the activation mode is switched to the second activation mode in which power supply to the display unit is stopped or reduced. Moreover, if the amount of total power consumption is further increased to be equal to or more than the second threshold value, the activation mode is switched to the third activation mode in which the heating unit is activated at a low heating temperature.

Accordingly, before switching to the third activation mode in which the print quality is affected is executed, switching to the second activation mode in which the print quality is not affected is executed. Thus, it is possible to suppress the increase in the amount of power consumption effectively while preventing the print quality from being greatly deteriorated.

According to a tenth illustrative aspect of the invention, the image output apparatus further comprises: a printing unit comprising an exposure unit, a transfer unit and heating and fixing unit so as to print the image on the recording medium electrophotographycally, wherein the activation mode further includes a third activation mode in which the heating unit is heated at a heating temperature lower than that in the second activation mode, and wherein the switching unit switches the activation mode from the second activation mode to the third activation mode when the amount of total power consumption is equal to or more than a second threshold value larger than the first threshold value.

According thereto, when the amount of total power consumption is equal to or more than the first threshold value, the activation mode is switched to the second activation mode in which the print quality is not affected. Further, when the amount of total power consumption is further increased to be equal to or more than the second threshold value, the activation mode is switched to the third activation mode in which the heating unit is activated at a low heating temperature. Thus, it is possible to suppress the increase in the amount of power consumption effectively while preventing the print quality from being greatly deteriorated.

According to an eleventh illustrative aspect of the invention, there is provided an image output apparatus, which outputs an image, and which is activated in an activation mode including a first activation mode and a second activation mode that consumes less power than the first activation mode, the image output apparatus comprising: a switching unit that selects one of the first activation mode and the second activation mode as the activation mode for activating the image output apparatus; and a storage unit that stores a total amount of power consumed on and after a reference time, wherein the switching unit switches the activation mode from the first activation mode to the second activation mode based on an operation by a user when the amount of total power consumption stored in the storage unit is equal to or more than a first threshold value.

According thereto, similar to the first illustrative aspect, it is possible to suppress the increase in the amount of total power consumption while reflecting a user's intention.

BRIEF DESCRIPTION OF THE DRAWINGS

Illustrative aspects of the invention will be described in detail with reference to the following figures wherein:

FIG. 2 is a table explaining print modes of the image forming apparatus;

FIG. 4 shows a display example of information notified to a user according to the first exemplary embodiment;

FIG. 6 is a display example of information notified to a user according to the second exemplary embodiment;

FIG. 8 is a display example of information notified to a user according to the third exemplary embodiment;

FIG. 9 is another display example of information notified to a user according to the third exemplary embodiment;

FIG. 11 is a table showing a restricted power value for each user; and

DETAILED DESCRIPTION

General Overview

Exemplary Embodiments

Exemplary embodiments of the invention will now be described with reference to the drawings.

An image output apparatus according to the invention is applied to an image forming apparatus including a print function and a scanner function.

(Image Forming Apparatus)

Figure 1:
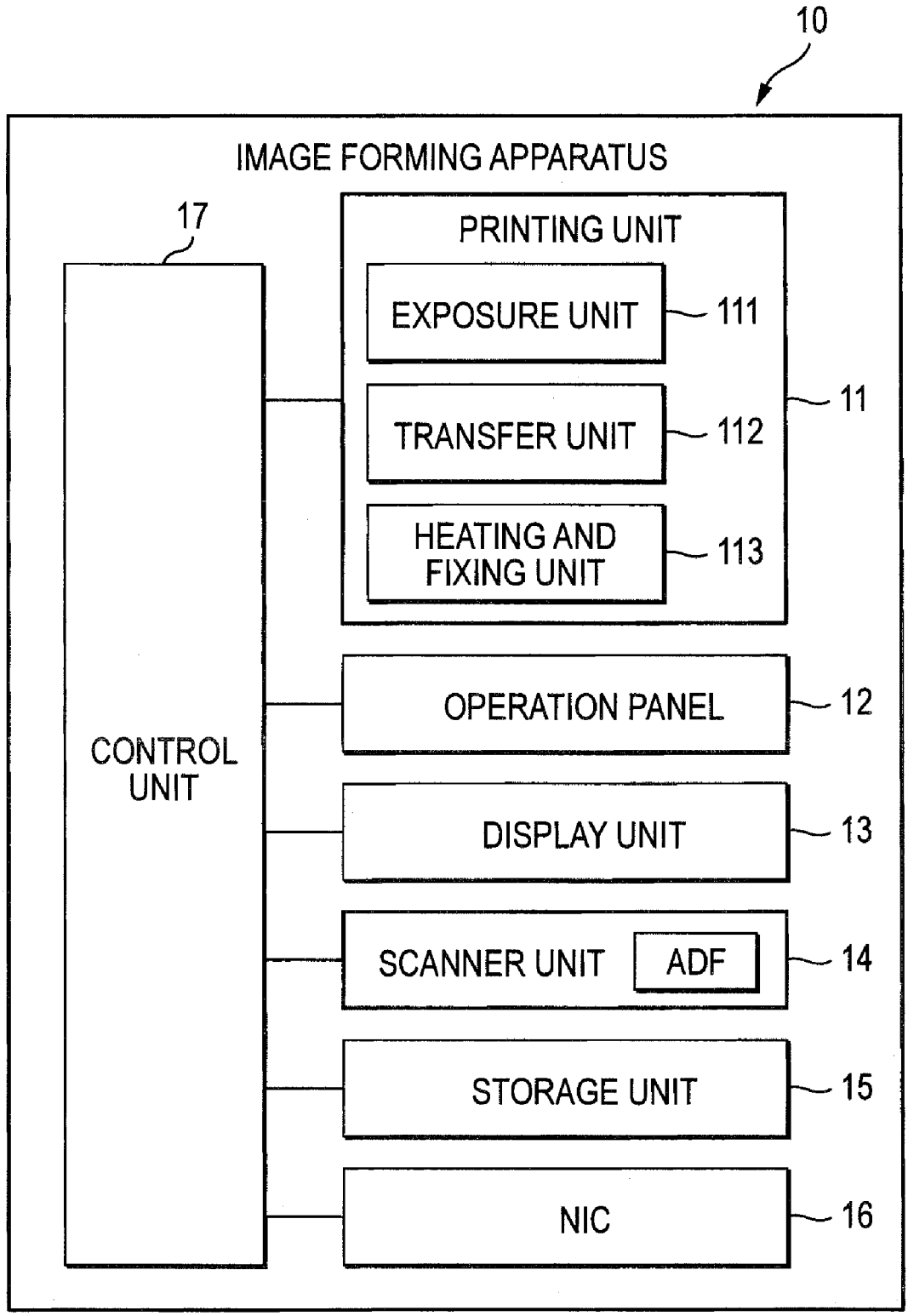
FIG. 1 is a block diagram of an image forming apparatus according to an exemplary embodiment of the invention.

Referring to FIG. 1, an image forming apparatus 10 according to the invention will be described.

The image forming apparatus includes: a printing unit 11 for forming an image on a sheet such as a recording sheet and an OHP sheet; an operation panel 12 to be operated by a user; a display unit 13 for displaying various types of information; a scanner unit 14 for scanning image information from a document and outputting image data from the scanned image information; a storage unit 15 (one example of a storage unit) formed by non-volatile storage such as a magnetic storage unit and a flash memory; a network-connecting interface such as a Network Interface Card (NIC) 16; and a control unit 17 (one example of a switching unit and a determining unit) for controlling the printing unit 11, etc.

The control unit 17 includes a CPU, ROM, and RAM. A program, etc., used for executing processing (described later) is stored in a non-volatile storage such as a ROM.

The image forming apparatus 10 is connectable to a computer (not shown) via a network such as an Ethernet, etc., connected to the NIC 16, and is capable of executing printing upon receiving a print command issued from the computer via the network.

The printing unit 11 includes an exposure unit 111, a transfer unit 112 and a heating and fixing unit 113 so as to form an image electrophotographically. A developer image transferred on the sheet by the transfer unit is heated by the heating and fixing unit 113, and is thermally fixed on the sheet.

The operation panel 12 is configured to include a touch switch operated by a user and a pilot lamp, such as an LED, indicating a state (ON, OFF, etc.) of the touch switch.

The display unit 13 is configured to include a liquid crystal panel (LCD) having a so-called touch panel function capable of detecting whether the user touches the display unit 13 and a position where the user touches. Therefore, the image forming apparatus 10 (control unit 17) is capable of receiving an instruction from the user not only through the operation panel 12 but also through the touch panel function.

Moreover, the scanner unit 14 includes an automatic document feeder (ADF) for automatically conveying the document to an image reading unit (not shown). The scanner unit 14 has a document scanning function using the automatic document feeder and a flatbed scanning function for scanning the document which is mounted on the image reading unit by the user.

(Activation of Image Forming Apparatus)

The image forming apparatus 10 has two or more print (activating) modes during formation of the image on the sheet (see, for example, left column in FIG. 2).

Based on a total amount of power consumption on and after a reference time (hereinafter, "amount of total power consumption"), the determination is automatically made as to which of the print modes, out of the following print modes, the printing should be processed. Incidentally, in the exemplary embodiment, a time when a main power supply switch (not shown) of the image forming apparatus 10 is turned ON is one example of the reference time. Then, in the determined print mode, a print job is executed.

(1) Normal Print Mode

A "normal print mode" is an activation mode for printing (forming) an image on the sheet as usual without implementing an energy-saving (power saving) activation mode described below, and this normal print mode consumes about 4 Wh of power during printing an image on one sheet. In the exemplary embodiment, the normal print mode is executed when the amount of total power consumption $\Sigma$ on and after the reference time (i.e., a time when the main power supply switch of the image forming apparatus 10 is turned ON) is equal to or more than 0 Wh and less than 300 Wh.

(2) Energy-Saving Mode 1

An "energy-saving mode 1" is an activation mode for executing the printing (print job) in a state where the pilot lamp, such as an LED, of the operation panel 12 is turned off, and power supply to an apparatus not directly affecting the activation of the printing unit 11 is stopped or reduced (e.g., a display of the display unit 13 (LCD) is stopped).

The energy-saving mode 1 consumes about 3.7 Wh of power during printing of an image on one sheet. In the exemplary embodiment, the energy-saving mode 1 is executed when the amount of total power consumption on and after the reference time is equal to or more than 300 Wh and less than 350 Wh.

(3) Energy-Saving Mode 2

An "energy-saving mode 2" is an activation mode for executing the printing (print job) in a state where, in addition to the execution of the energy-saving mode 1, a conveyance speed of sheet is decreased more than that in the normal print mode (i.e., about 50% of the normal print mode in the exemplary embodiment).

The energy-saving mode 2 consumes about 3.0 Wh of power during printing of an image on one sheet. Incidentally, in the exemplary embodiment, the energy-saving mode 2 is executed when the amount of total power consumption on and after the reference time is equal to or more than 350 Wh and less than 400 Wh.

(4) Energy-Saving Mode 3

An "energy-saving mode 3" is an activation mode for executing the printing (print job) in a state where, in addition to the execution of the energy-saving mode 2, a heating temperature of heating and fixing unit (hereinafter, "fixing unit") 13 is set to a temperature lower than that in the normal print mode (i.e., a temperature lower by about 10° C. than that in the normal print mode in the exemplary embodiment).

The energy-saving mode 3 consumes about 2.0 Wh of power during printing of an image on one sheet. Incidentally, in the exemplary embodiment, the energy-saving mode 3 is executed when the amount of total power consumption on and after the reference time is equal to or more than 400 Wh and less than 450 Wh.

(5) Energy-Saving Mode 4

An "energy-saving mode 4" is an activation mode for executing the printing (print job), in a state where, in addition to the execution of the energy-saving mode 2, a heating temperature of the fixing unit 113 is set to a temperature lower than those in the normal print mode and the energy-saving mode 3 (i.e., a temperature lower by about 20° C. than that in the normal print mode in the exemplary embodiment).

The energy-saving mode 4 consumes about 1.8 Wh of power during printing of an image on one sheet. Incidentally, in the exemplary embodiment, the energy-saving mode 4 is executed when the amount of total power consumption on and after the reference time is equal to or more than 450 Wh and less than 500 Wh.

(6) Printing Prohibition Mode

"printing prohibition mode" refers to an activation mode, in which the activation of the printing unit 11 is prohibited, and the execution of printing (print job) is not possible. Incidentally, in the exemplary embodiment, the printing prohibition mode is executed when the amount of total power consumption on and after the reference time is equal to or more than 500 Wh (hereinafter, this amount of total power consumption is referred to as a "restricted power value T5").

Incidentally, in the exemplary embodiment, the time when the main power supply switch is turned ON is the reference time. Thus, when the main power supply switch is turned OFF, a total amount of power consumption is reset to 0, and thereby, the printing prohibition mode can be canceled.

Incidentally, in the exemplary embodiment, an average per-sheet amount of power consumption in each of the print modes is set as follows.

That is, before shipment of the image forming apparatus 10, an amount of power consumption Pa when the image forming apparatus 10 prints X sheets in a state where the print mode is fixed and an amount of power consumption (amount of standby power) Pb of the image forming apparatus 10 when the image forming apparatus 10 is in a standby state for a period of time required for printing X sheets while not performing the printing are measured with a watt-hour meter before the shipment of the image forming apparatus 10, and the measured values are substituted for (A−B)/X. In this way, the calculated value is used as an average per-sheet amount of power consumption in each print mode.

First Exemplary Embodiment

Figure 3:
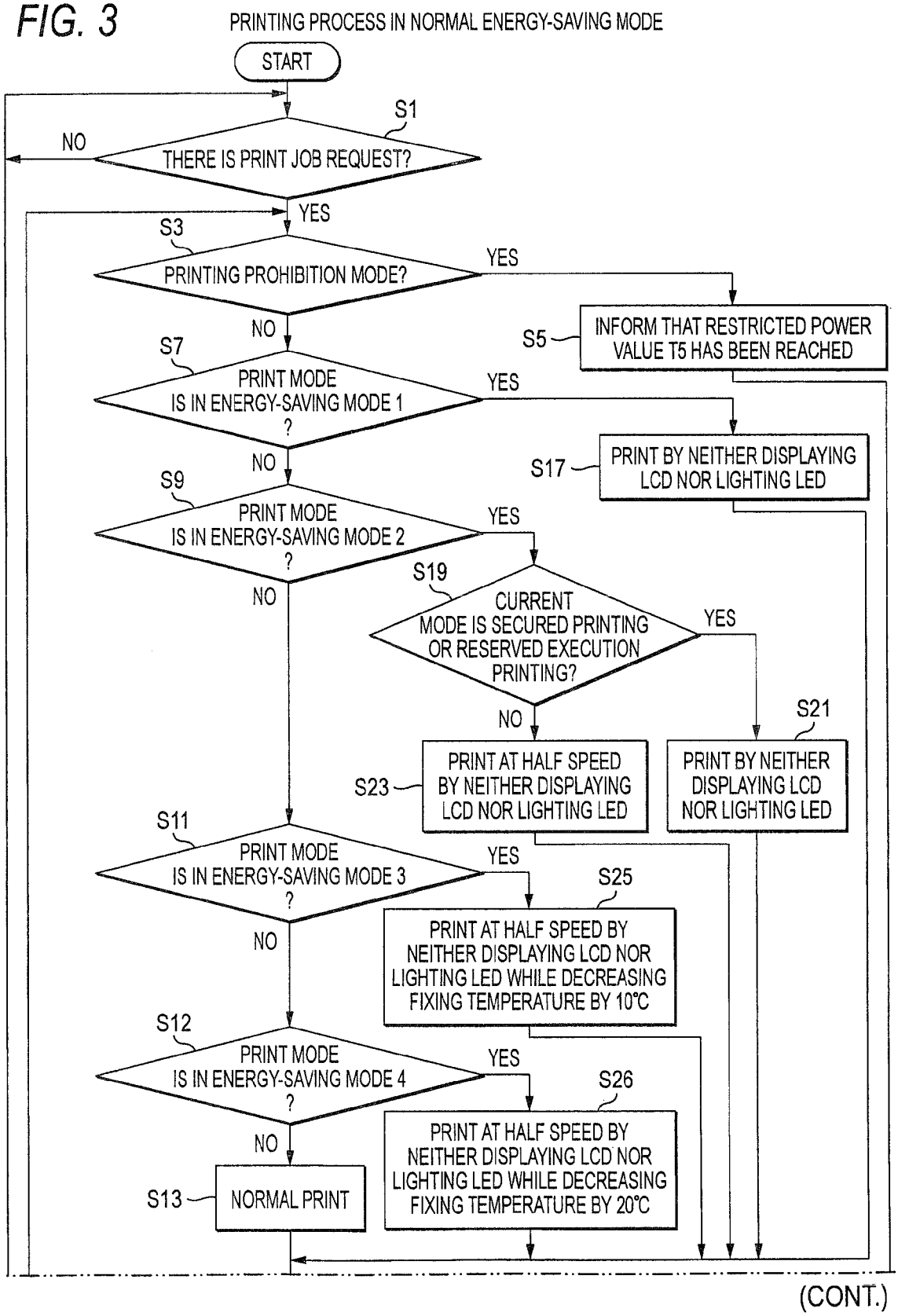
FIG. 3 is a flowchart showing a process of the image forming apparatus according to a first exemplary embodiment of the invention.

Referring to FIG. 3, a printing process of the image forming apparatus 10 according to a first exemplary embodiment of the invention will be described. A program used for executing this flowchart is started up when the main power supply switch is turned ON and executed in the control unit 17 (CPU), and is ended when the main power supply switch is turned OFF.

Then, when the program is started up, first, it is determined whether a request for the print job (printing) is issued from a computer, etc. (S1), and if it is determined that the print job is not requested (S1: NO), the process at S1 is executed again, and if it is determined that the print job is requested (S1: YES), it is determined whether the current print mode is the printing prohibition mode (S3).

At this time, if it is determined that the current mode is the printing prohibition mode (S3: YES), the amount of total power consumption is equal to or more than the restricted power value T5, and after a display indicating that the print mode has shifted to the activation mode not capable of executing the print job (see FIG. 4) is displayed on the display unit 13 (S5), the process at S1 is executed again.

In contrast, if it is determined that the current mode is not the printing prohibition mode (S3: NO), it is determined whether the current print mode is the energy-saving mode 1 (S7). If it is determined that the current mode is not the energy-saving mode 1 (S7: NO), it is determined whether the current print mode is the energy-saving mode 2 (S9).

Then, if it is determined that the current mode is not the energy-saving mode 2 (S9: NO), it is determined whether the current print mode is the energy-saving mode 3 (S11). If it is determined that the current mode is not the energy-saving mode 3 (S11: NO), it is determined whether the current mode is energy-saving mode 4 (S12). If it is determined that the current mode is not the energy-saving mode 4 (S12: NO), one-page printing is executed in the normal print mode (S13).

Thereafter, the power consumed during the print execution for this time is added to the amount of total power consumption up to a time point at which the printing for the last time is completed, and the added amount of total power consumption is stored in the storage unit 15 or in the RAM (S15).

Incidentally, in the first exemplary embodiment, as the amount of power consumed during the print job execution, "average per-sheet amount of power consumption set to each print mode (i.e., an amount of power consumed during printing of an image on one sheet)" and "a number of sheets printed by executing the print job" are accumulated. Hereinafter, the power stored in the storage unit 15 or the RAM is referred to as the amount of total power consumption Σ.

At S7, if it is determined that the print mode is the energy-saving mode 1 (S7: YES), the printing is executed under a condition while the pilot lamp such as an LED of the operation panel 12 and the display on the display unit 13 (LCD) are turned off (S17).

At S9, if it is determined that the print mode is the energy-saving mode 2 (S9: YES), it is determined whether the current print job is a secured printing or a reserved execution printing (S19). If it is determined that the print job is the secured printing, etc., (S19: YES), the printing is executed under a condition where the pilot lamp such as the LED of the operation panel 12 and the display on the display unit 13 (LCD) are turned off (S21).

In contrast, if it is determined that the print job is not the secured printing, etc. (S19: NO), the printing is executed under a condition where the pilot lamp such as the LED of the operation panel 12 and the display of the display unit 13 (LCD) are turned off and the conveyance speed of sheet is set to about 50% of that in the normal print mode (S23).

The "secured printing" is printing having a function of actually executing the print job only when an explicit print instruction is issued from the user toward the image forming apparatus after the print job is requested, for example, in order to prevent printing matter from being seen by a third person. The "reserved execution printing" is printing in which the print job is executed at a time designated by the user.

Thus, with respect to the secured printing and the reserved execution printing, the print command is usually issued from a computer, etc., to the image forming apparatus 10 at a timing earlier than a timing at which these print jobs are actually executed. Therefore, in the first exemplary embodiment, if the jobs of the secured printing and the reserved execution printing are executed in the energy-saving mode 2, the print commands of these print jobs are regarded to be issued during a previous print mode (energy-saving mode 1) that is established before being shifted to the energy-saving mode 2, and the printing is executed under settings that is identical to a case where the current print mode is determined to be the energy-saving mode 1 (S7: YES).

At S11, if it is determined that the print mode is the energy-saving mode 3 (S11: YES), the printing is executed under a condition where the pilot lamp such as the LED of the operational panel 12 and the display on the display unit 13 (LCD) are turned off, the conveyance speed of sheet is set to about 50% of that in the normal print mode, and the heating temperature of the fixing unit 113 is decreased by about 10° C. than that in the normal print mode (S25).

At S12, if it is determined that the print mode is the energy-saving mode 4 (S12: YES), the printing is executed under a condition where the pilot lamp such as the LED of the operational panel 12 and the display on the display unit 13 (LCD) are turned off, the conveyance speed of sheet is set to about 50% of that in the normal print mode, and the heating temperature of the fixing unit 113 is decreased by about 20° C. than that in the normal print mode (S26).

After the one-page printing is completed, the "average per-sheet amount of power consumption set to each print mode (i.e., an amount of power consumed during printing of an image on one sheet)" in the current print mode is added to the amount of total power consumption Σ stored in the storage unit 15 (S15). Then, it is determined whether the stored amount of total power consumption Σ is equal to or more than the first predetermined amount of power T1 (300 Wh) and less than the second predetermined amount of power T2 (350 Wh) (S27). If it is not determined that the amount of total power consumption Σ is equal to or more than the first predetermined amount of power T1 and less than the second predetermined amount of power T2 (S27: NO), it is determined whether the amount of total power consumption Σ is equal to or more than the second predetermined amount of power T2 and less than the third predetermined amount of power T3 (400 Wh) (S29).

At this time, if it is not determined that the amount of total power consumption Σ is equal to or more than the second predetermined amount of power T2 and less than the third predetermined amount of power T3 (S29: NO), it is determined whether the amount of total power consumption Σ is equal to or more than the third predetermined amount of power T3 and less than the fourth predetermined amount of power T4 (450 Wh) (S31). If it is not determined that the amount of total power consumption Σ is equal to or more than the third predetermined amount of power T3 and less than the fourth predetermined amount of power T4 (S31: NO), it is determined whether the amount of total power consumption Σ is equal to or more than the fourth predetermined amount of power T4 and less than the restricted power value T5 (S33).

If it is determined that the amount of total power consumption Σ is equal to or more than the fourth predetermined amount of power T4 and less than the restricted power value T5 (S33: NO), it is determined whether the amount of total power consumption Σ is equal to or more than the restricted power value T5 (S35). If it is determined that the amount of total power consumption Σ is not equal to or more than the restricted power value T5 (S35: NO), it is determined whether printing all the pages is completed (S37).

At this time, if it is determined that printing all the pages is not completed (S37: NO), the process at S3 is executed again. In contrast, if it is determined that printing all the pages is completed (S37: YES), the process at S1 is executed again.

At S27, if it is determined that the total power consumption Σ is equal to or more than the first predetermined amount of power T1 and less than the second predetermined amount of power T2 (S27: YES), the print mode is set to the energy-saving mode 1 (S39), and then a process at S37 is executed. If it is determined at S29 that the amount of total power consumption Σ is equal to or more than the second predetermined amount of power T2 and less than the third predetermined amount of power T3 (S29: YES), the print mode is set to the energy-saving mode 2 (S41), and then the process at S37 is executed.

At S31, if it is determined that the amount of total power consumption Σ is equal to or more than the third predetermined amount of power T3 and less than the fourth predetermined amount of power T4 (S31: YES), the print mode is set to the energy-saving mode 3 (S43), and then the process at S37 is executed. If it is determined at S33 that the amount of total power consumption Σ is equal to or more than the fourth predetermined amount of power T4 and less than the restricted power value T5 (S33: YES), the print mode is set to the energy-saving mode 4 (S45), and then the process at S37 is executed.

At S35, if it is determined that the amount of total power consumption Σ is equal to or more than the restricted power value T5 (S35: YES), the print mode is set to the printing prohibition mode (S47), and then, the process at S37 is executed.

In the first exemplary embodiment, when the amount of power actually consumed on and after a reference time (amount of total power consumption Σ) is equal to or more than a predetermined amount of power, the current mode is shifted to another print mode in which a small amount of power is consumed, and in this state, the image forming apparatus 10 is driven. Thus, it is possible to suppress an increase in the amount of power consumption.

Moreover, in the first exemplary embodiment, even when the print job is in the process of execution, it is determined whether the amount of total power consumption Σ is equal to or more than the predetermined amount of power at each ending of one-page printing, and when the amount of total power consumption Σ is equal to or more than the predetermined amount of power, the print mode is switched to another print mode in which a small amount of power is consumed. Therefore, it is possible to suppress an increase in the amount of power reliably.

Incidentally, the display unit, such as the display unit 13 and the LED, for notifying the user of the information is not an apparatus directly affecting the printing matter output from the printing unit 11. Thus, even if the power supply to the display unit 13, etc., is stopped or reduced, the quality of the output printing matter will not be adversely affected. Therefore, in the energy-saving mode 1, it is possible to suppress an increase in the amount of power consumption without adversely affecting the print quality such as quality of the image.

In the energy-saving mode 2, the conveyance speed of sheet is slower than that in the normal print mode. Accordingly, it is possible to suppress an increase in the power consumed by the conveyance of the sheet (for example, the power consumption in an electric motor for conveyance).

Incidentally, if the conveyance speed of sheet is controlled to be reduced, even though the print speed is reduced, print quality of the printing unit 11 is not deteriorated. Therefore, also in the energy-saving mode 2, it is possible to suppress an increase in the amount of power consumption without adversely affecting the print quality.

Generally, in an image forming apparatus that forms an image electrophotographycally, the power consumed in the fixing unit occupies a large proportion. However, according to the energy-saving mode 3 and the energy-saving mode 4 of the invention, it becomes possible to activate the fixing unit at a heating temperature lower than that in the normal print mode so as to reduce the power consumed in the fixing unit. According thereto, it is possible to suppress an increase in the amount of power consumption effectively.

Incidentally, if the heating temperature of the fixing unit is lowered, the print quality may be deteriorated. Thus, in the exemplary embodiment, "lowering the heating temperature of the fixing unit" is only carried out in the energy-saving mode 3 and the energy-saving mode 4, in which the increase in the amount of power consumption is to be further suppressed.

Further, according to the exemplary embodiment, by reducing a temperature difference (i.e., about 10° C. in the exemplary embodiment) in the heating temperature of the fixing unit between the energy-saving mode 2 and the energy-saving mode 3 or between the energy-saving mode 3 and the energy-saving mode 4, it is possible to suppress the deterioration of the print quality when switching the energy-saving mode to another energy-saving mode in which a small amount of power is consumed.

Second Exemplary Embodiment

In the first exemplary embodiment, each time one-page printing is ended, it is determined in which of the print modes the printing should be executed, and then, the print modes are switched. Thus, before one print job (printing all the pages) is completed, i.e., from a certain midpoint of execution of the print job, the print modes may also be switched.

On the other hand, according to a second exemplary embodiment, before the print job is executed, it is determined whether completion of that print job is possible without changing the current printing mode during execution of the print job thereof. If it is determined that completion of the print job is not possible, the current print mode is changed to a print mode in which the determination can be made that completion of the print job is possible without changing the printing mode during execution of the print job thereof, and the print job is executed. Hereinafter, the details will be described according to a flowchart shown in FIG. 5.

Figure 5:
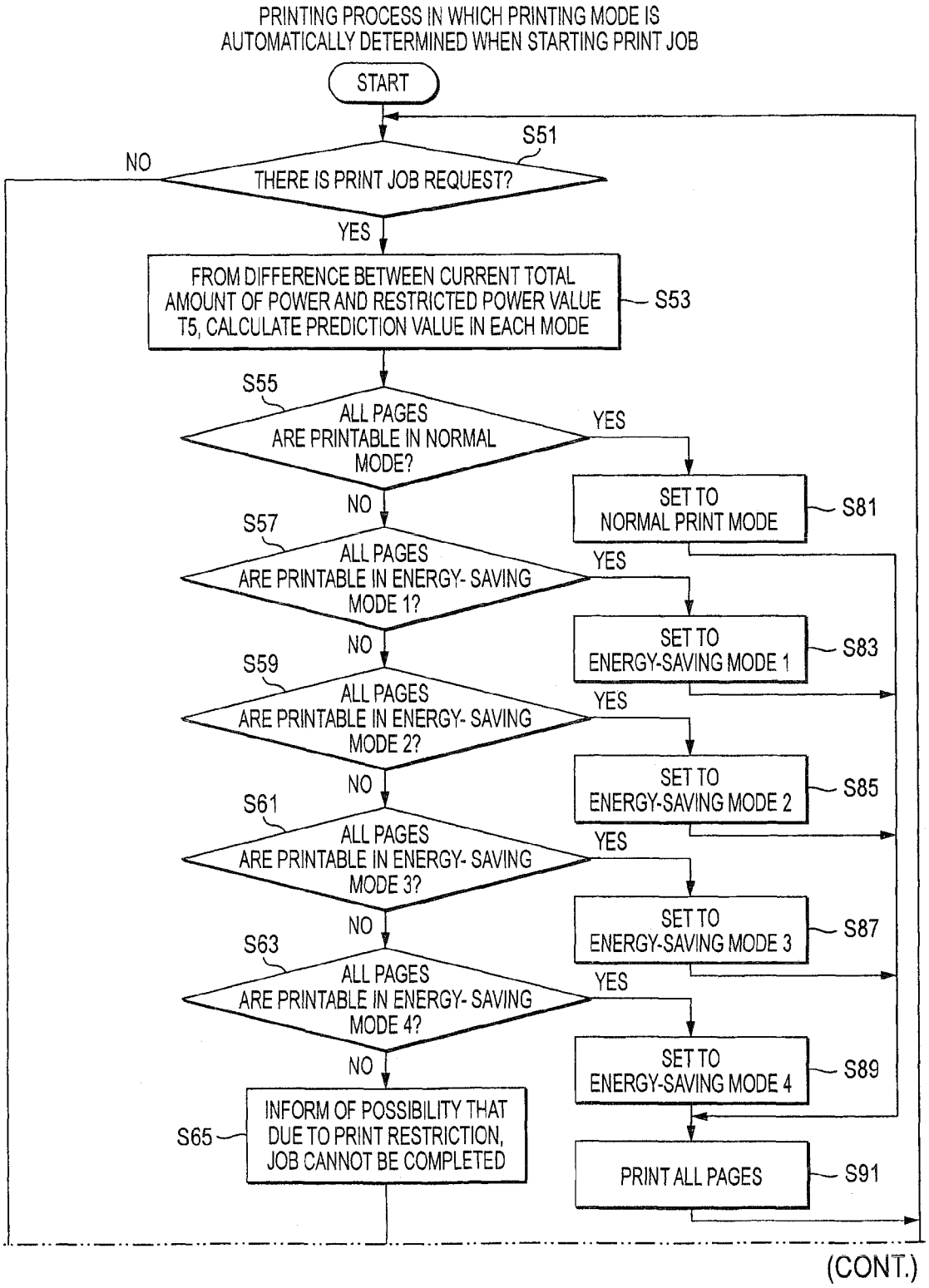
FIG. 5 is a flowchart showing a process of the image forming apparatus according to a second exemplary embodiment of the invention.

A program used for executing the flowchart shown in FIG. 5 is started up when the main power supply switch is turned ON and executed in the control unit 17 (CPU). When the main power supply switch is turned OFF, the program is ended.

Then, when the program is started up, first, it is determined whether a request for the print job (printing) is issued from a computer, etc. (S51). If it is determined that the print job is not requested (S51: NO), the process at S51 is executed again.

In contrast, if it is determined that a request for the print job is issued (S51: YES), from a difference between the current amount of total power consumption Σ and the restricted power value T5, a prediction value indicating the number of printable pages in each print mode is calculated (S53).

In the second exemplary embodiment, a quotient obtained by dividing the difference between the current amount of total power consumption Σ and the restricted power value T5 by the amount of power consumed during printing of an image on one sheet (see FIG. 2) is used as a prediction value. That is, in the normal print mode, for example, a quotient obtained by dividing the difference between the current amount of total power consumption Σ and the restricted power value T5 by "4" is a prediction value in the normal print mode. Here, an average per-sheet amount of power consumption in the normal print mode is 4 [Wh/sheet] as shown in FIG. 2.

Next, based on the prediction value calculated at S53, it is determined whether printing all the pages of the print job that is requested to be printed in the normal print mode is possible (S55). If it is determined that printing all the pages is not possible (S55: NO), it is determined whether printing all the pages of the print job that is requested to be printed in the energy-saving mode 1 is possible (S57).

At this time, if it is determined that printing all the pages in the energy-saving mode 1 is not possible (S57: NO), it is determined whether printing all the pages of the print job that is requested to be printed in the energy-saving mode 2 is possible (S59). If it is determined that printing all the pages in the energy-saving mode 2 is not possible (S59: NO), it is determined whether printing all the pages of the print job that is requested to be printed in the energy-saving mode 3 is possible (S61).

Then, if it is determined that printing all the pages in the energy-saving mode 3 is not possible (S61: NO), it is determined whether printing all the pages of the print job that is requested to be printed in the energy-saving mode 4 is possible (S63). If it is determined that printing all the pages in the energy-saving mode 4 is not possible (S63: NO), it means that the amount of total power consumption Σ is probably equal to or more than the restricted power value T5. Thus, the display unit 13 displays a notice informing of a possibility that printing all the pages of the print job that is requested to be printed is not possible (see FIG. 6) (S65).

Next, based on the input value from the user (see FIG. 6), it is determined whether the print job is executed (S67). If it is determined that the print job is not executed (S67: NO), after the print job is discarded (deleted) (S69), the process at S51 is executed again.

In contrast, if it is determined that the print job is executed (S67: YES), after the print mode is set to the energy-saving mode 4 (S71), one-page data is printed (S73). Thereafter, the amount of power consumed during the print execution for this time is added to the amount of total power consumption Σ that has been consumed until a time point at which the printing for the last time is completed, and the added amount of total power consumption Σ is stored in the storage unit 15 or the RAM (S75).

Next, it is determined whether the amount of total power consumption Σ is equal to or more than the restricted power value T5 (S77). If it is determined that the amount of total power consumption Σ is equal to or more than the restricted power value T5 (S77: YES), the data of the remaining pages is discarded (deleted), and then, the process at S51 is executed again.

In contrast, if it is determined that the amount of total power consumption Σ is not equal to or more than the restricted power value T5 (S77: NO), it is determined whether printing all the pages is completed (S79). If it is determined that printing all the pages is not completed (S79: NO), the process at S73 is executed again. In contrast, if it is determined that printing all the pages is completed (S79: YES), the process at S51 is executed again.

If it is determined at S55 that printing all the pages in the normal print mode is possible (S55: YES), after the print mode is set to the normal print mode (S81), all the pages are printed (S91). At S91, even when the amount of total power consumption Σ is equal to or more than the predetermined amount of power or the restricted power value T5 in a certain midpoint of the execution of the print job, all the pages are printed without switching the print modes.

Then, when all the pages are printed and the print job is completed, the amount of power consumed during the print execution of all the pages is added to the amount of total power consumption Σ that has been consumed until a time point at which the printing for the last time is completed, and after the added amount of total power consumption Σ is stored in the storage unit 15 or the RAM (S93), the process at S51 is executed again.

At S57, if it is determined that printing all the pages in the energy-saving mode 1 is possible (S57: YES), after the print mode is set to the energy-saving mode 1 (S83), all the pages are printed (S91).

At S59, if it is determined that printing all the pages in the energy-saving mode 2 is possible (S59: YES), after the print mode is set to the energy-saving mode 2 (S85), all the pages are printed (S91).

At S61, if it is determined that printing all the pages is possible in the energy-saving mode 3 (S61: YES), after the print mode is set to the energy-saving mode 3 (S87), all the pages are printed (S91).

At S63, if it is determined that printing all the pages in the energy-saving mode 4 is possible (S63: YES), after the print mode is set to the energy-saving mode 4 (S89), all the pages are printed (S91).

In the second exemplary embodiment, before the print job is executed, it is determined whether completion of the print job is possible. If it is determined that the completion of the print job is not possible, the print job is executed in a print mode in which the determination can be made that completion of the print job is possible. Thus, it is possible to suppress an increase in the amount of power consumption reliably without the print modes being switched in a certain point during execution of the print job.

Third Exemplary Embodiment

In the second exemplary embodiment, the image forming apparatus 10 automatically selects the print mode capable of completing the print job that is requested to be printed, and executes the print job. However, according to a third exemplary embodiment, the user selects the print mode, and by the print mode selected by the user, the print job is executed. Hereinafter, the details will be described according to a flowchart shown in FIG. 7.

Figure 7:
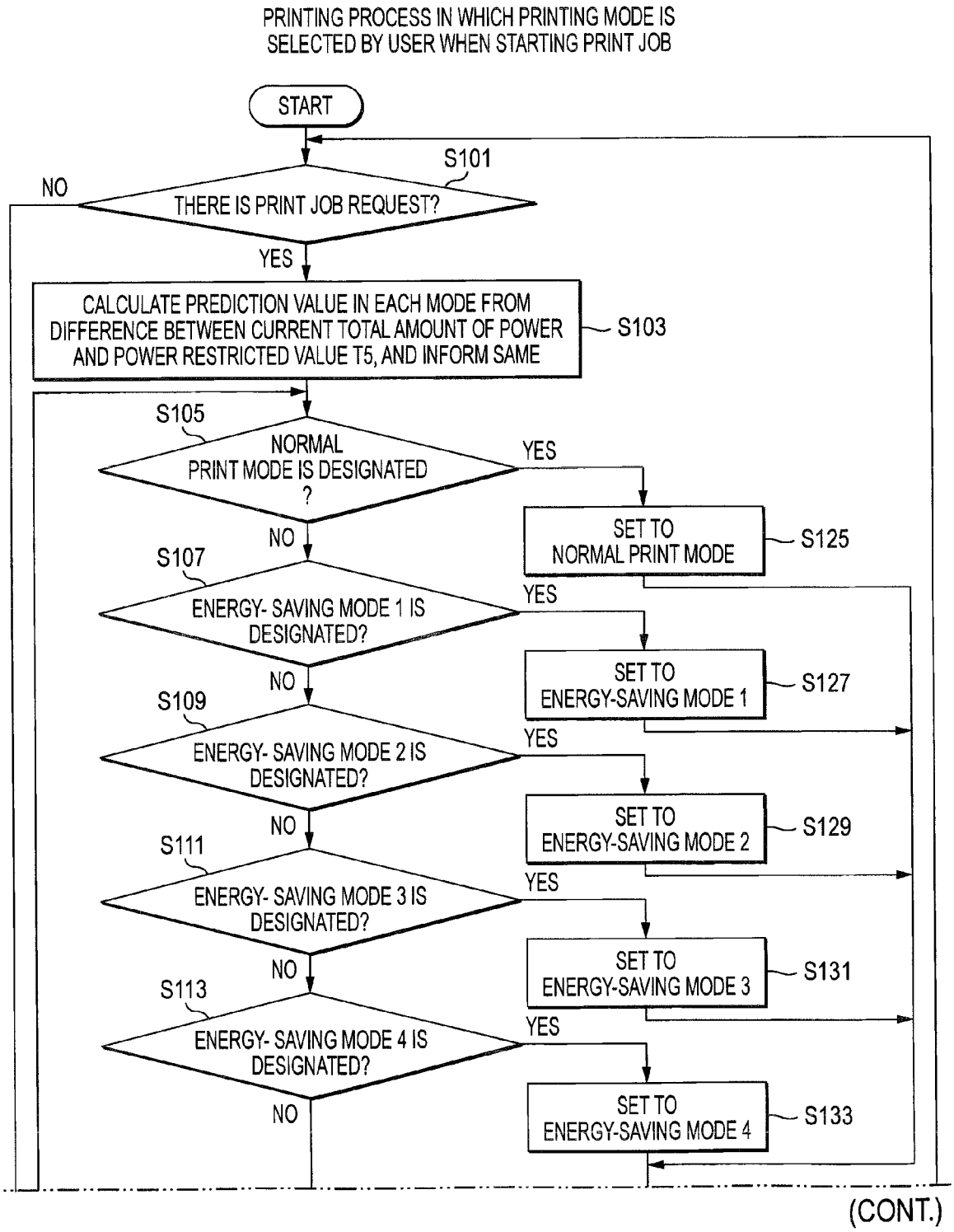
FIG. 7 is a flowchart showing a process of the image forming apparatus according to a third exemplary embodiment of the invention.

A program used for executing the flowchart shown in FIG. 7 is started up when the main power supply switch is turned ON and executed in the control unit 17 (CPU). When the main power supply switch is turned OFF, the program is ended.

Then, when the program is started up, first, it is determined whether a request for the print job (printing) is issued from a computer, etc. (S101). If it is determined that the print job is not requested (S101: NO), the process at S101 is executed again.

In contrast, if it is determined that the print job is requested (S101: YES), a prediction value indicating the number of printable pages in each print mode is calculated from a difference between the current amount of total power consumption Σ and the restricted power value T5, according to a method similar to that at S53 in the second exemplary embodiment, and at the same time, the prediction value (see FIG. 8) and a selection menu screen used by the user to select the print mode (see FIG. 9) are displayed on the display unit 13 (S103).

Next, it is determined which print modes are selected by the user or whether the print job is canceled by the user (S105 to S113). Then, if it is determined that any one of the print modes is selected by the user (S105: YES, S107: YES, S111: YES, and S113: YES), the print mode is set to the print mode selected by the user (S125 to S133), and thereafter, one-page data is printed (S117).

After the one-page printing is ended (S117), the amount of power consumed during execution of the one-page printing is added to the total amount of power consumption Σ that has been consumed until a time point at which the printing for the last time is completed. Then, the added total amount of power consumption Σ is stored in the storage unit 15 or RAM (S118).

Next, it is determined whether the amount of total power consumption Σ is equal to or more than the restricted power value T5 (S119). If it is determined that the amount of total power consumption Σ is equal to or more than the restricted power value T5 (S119: YES), the data of the remaining pages is discarded (deleted). Thereafter, the process at S101 is executed again.

At S115, if it is determined that canceling of the print job is selected by the user (S115: YES), data of all the pages is discarded (deleted) (S123). Thereafter, the process at S101 is executed again. Incidentally, if neither of the print modes is selected or the canceling of the print job is not selected by the user (S115: NO), the process at S105 is executed again.

In the third exemplary embodiment, the print job is executed in the print mode selected by the user. Therefore, it is possible to suppress an increase in the amount of total power consumption while reflecting a user's intention.

In the third exemplary embodiment, when the amount of total power consumption Σ is equal to or more than the restricted power value T5 (S121: YES), the print job is stopped and the data of the remaining pages is discarded. However, the third exemplary embodiment is not limited thereto. For example, the process at S121 may be abolished and the print job may be optionally completed in the print mode selected by the user.

Fourth Exemplary Embodiment

Figure 10:
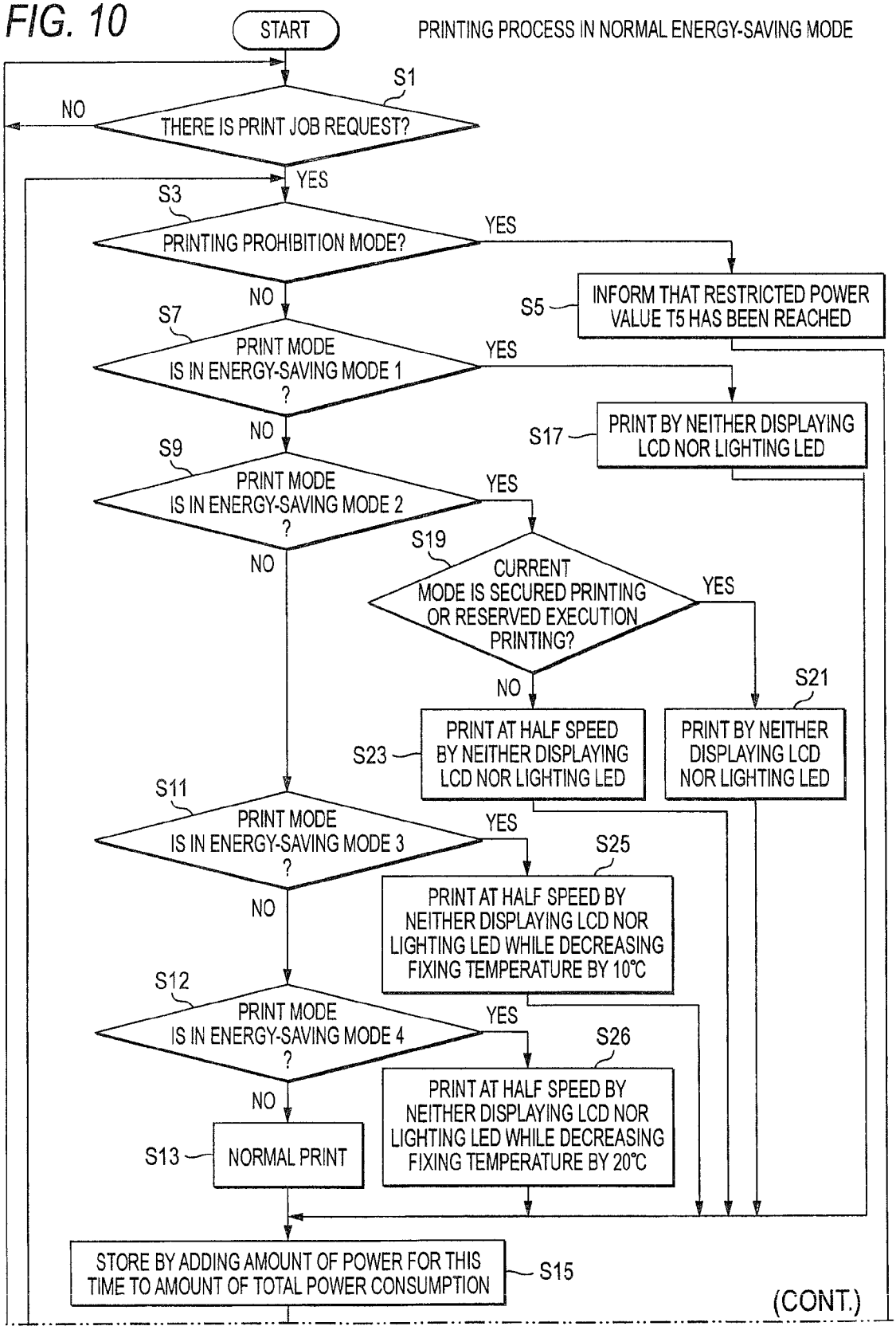
FIG. 10 is a flowchart showing a process of the image forming apparatus according to a fourth exemplary embodiment of the invention.

According to a fourth exemplary embodiment, as shown at S38, S40, S42, S44, and S46 in FIG. 10, before the print modes are changed, the user is notified that the print mode is about to be changed, and at the same time, the user is requested to permit (confirm) a print mode change.

Incidentally, control steps which are the same as those in the above-described exemplary embodiments are given the same reference number, and a description thereof will be omitted.

That is, if it is determined that the print mode change is permitted by the user at S38, S40, S42, S44, and S46 (S38: YES, S40: YES, S42: YES, S44: YES, and S46: YES), the print modes are actually changed (S39, S41, S43, S45, and S47). In contrast, if it is determined that the print mode change is not permitted by the user (S38: NO, S40: NO, S42: NO, S44: NO, and S46: NO), the print mode is not changed and the process at S1 is executed.

Thereby, in the fourth exemplary embodiment, when the amount of total power consumption Σ is equal to or more than the predetermined amount of power, the print job is executed in the print mode selected based on the user's operation. Therefore, it is possible to suppress an increase in the amount of total power consumption Σ while reflecting a user's intention.

In FIG. 10, the fourth exemplary embodiment is described by using the control shown in FIG. 3(*first* embodiment) as an example. However, the fourth exemplary embodiment is not limited thereto, and the fourth exemplary embodiment can be applied to other exemplary embodiments.

Fifth Exemplary Embodiment

According to a fifth exemplary embodiment, the restricted power value T5 is set to each user who issues a print command to the image forming apparatus 10 (see FIG. 11). In addition, the restricted power value T5 set to each user can be set via the operation panel 12, and the restricted power value T5 set to each user is stored in the storage unit 15.

Figure 12:
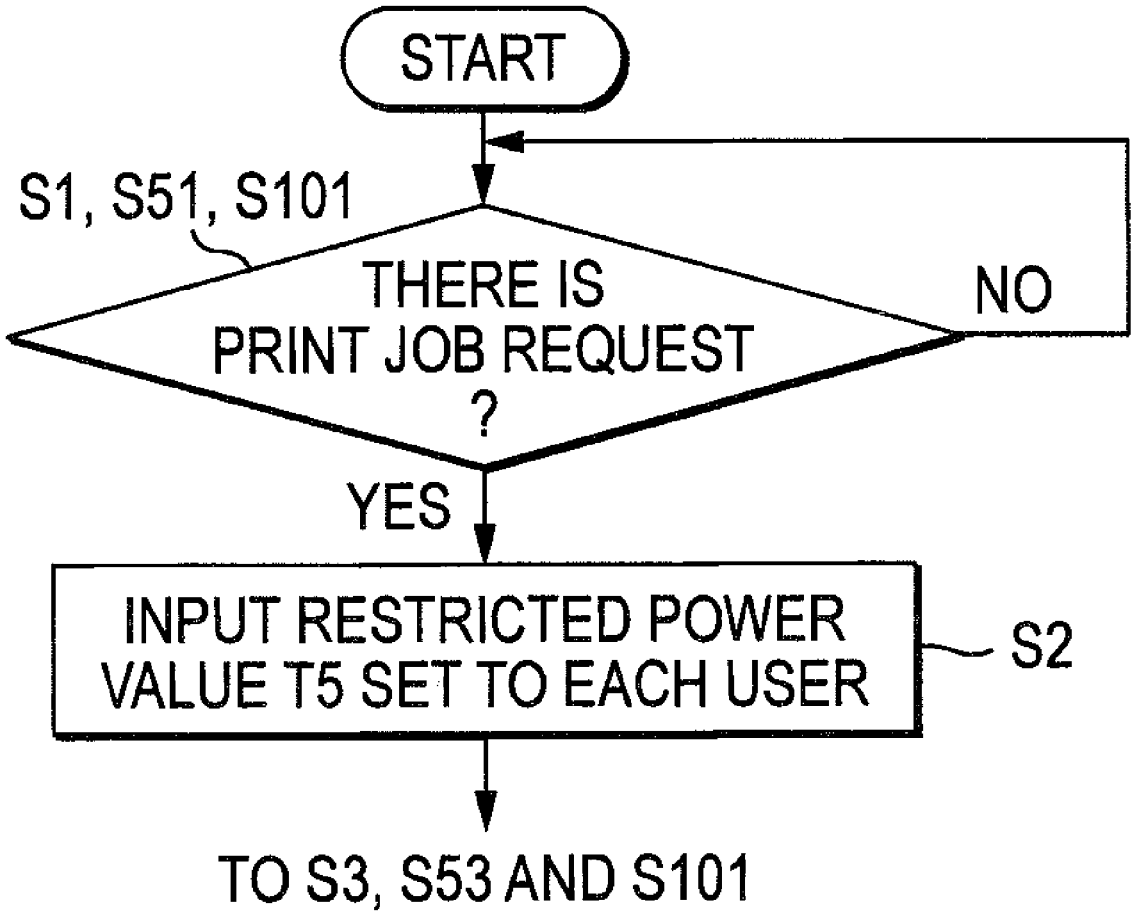
FIG. 12 is a flowchart showing a process of the image forming apparatus according to a fifth exemplary embodiment of the invention.

That is, in the fifth exemplary embodiment, as shown in FIG. 12, if it is determined that the print job is requested (S1: YES, S51: YES, and S101: YES), the restricted power value set to each user is input to the restricted power value T5 (see FIG. 11) (S2).

Then, at and after S2, until the print job is completed or discarded, the value input at S2 is regarded as the restricted power value T5. In this way, the image forming apparatus 10 is controlled. In addition, at and after S2, the image forming apparatus 10 is controlled according to flowcharts shown in FIG. 3, FIG. 5 or FIG. 7.

In the fifth exemplary embodiment, the restricted power value T5 can be made to differ depending on each user. Therefore, the amount of total power consumption Σ can also be stored in the storage unit 15 for each user (see FIG. 11).

Modification to Exemplary Embodiments

In the above-described exemplary embodiments, the invention is described by using an example in which the image is output as printing matter. However, the invention is not limited thereto. For example, the image output apparatus can also be applied to a scanner in which an image of a document is read and the image is output as electronic data.

In addition, if the invention is applied to the scanner, the energy-saving mode 3 and the energy-saving mode 4 cannot be executed, but the normal print mode, the energy-saving mode 1, and the energy-saving mode 2 can be executed. The conveyance speed in the energy-saving mode 2 in this example is a conveyance speed of a document conveyed by the automatic document feeder (ADF).

The activation modes other than the normal print mode are not limited to those in the above-described exemplary embodiments, and may optionally include other activation modes.

In the above-described exemplary embodiments, in accordance with an increase in the amount of total power consumption Σ, the print modes are switched from the normal print mode→energy-saving mode 1→energy-saving mode 2→energy-saving mode 3→energy-saving mode 4→printing prohibition mode. However, the invention is not limited thereto, and for example, the print modes may be switched only to one or two print modes selected from the normal print mode and the energy-saving modes 1 to 4.

In the above-described exemplary embodiments, as the energy-saving mode 1, the printing is executed in a state where the pilot lamp, such as an LED, of the operation panel 12 is turned off and the display of the display unit 13 (LCD) is stopped, however, the invention is not limited thereto. For example, the power supplied to the display unit 13, etc., may be decreased as compared to that in the normal print mode.

In the above-described exemplary embodiments, the time when the main power supply switch is turned ON is used as the reference time to accumulate the amounts of power consumption, thereby determining the amount of total power consumption Σ. However, the invention is not limited thereto. For example, a time at which a date or a month changes may be optionally used as the reference time.

In the above-described exemplary embodiments, the amount of total power consumption Σ is sequentially accumulated by using "the amount of power, set to each print mode, consumed during printing of an image on one sheet (see FIG. 2)." However, the invention is not limited thereto. For example, the amount of power input to the power supply circuit of the image forming apparatus 10 may be directly measured to calculate the amount of power consumption.

While the present invention has been shown and described with reference to certain exemplary embodiments thereof, it will be understood by those skilled in the art that various changes in form and details may be made therein without departing from the scope of the invention as defined by the appended claims.

What is claimed is:

1. An image output apparatus, which outputs an image on a recording medium, and which is activated in an activation mode including a first activation mode and a second activation mode that consumes less power than the first activation mode, the image output apparatus comprising:

a switching unit that selects one of the first activation mode and the second activation mode as the activation mode for activating the image output apparatus; and a storage unit that stores a total amount of power consumed on and after a reference time; and a printing unit comprising an exposure unit, a transfer unit and heating and fixing unit so as to print the image on the recording medium electrophotographically, wherein the switching unit switches the activation mode from the first activation mode to the second activation mode when the amount of total power consumption stored in the storage unit is equal to or more than a first threshold value, wherein the activation mode further includes a third activation mode in which the heating unit is heated at a heating temperature lower than that in the second activation mode, and wherein the switching unit switches the activation mode from the second activation mode to the third activation mode when the amount of total power consumption is equal to or more than a second threshold value larger than the first threshold value.

2. The image output apparatus according to claim 1, wherein the switching unit switches the activation mode from the first activation mode to the second activation mode when the amount of total power consumption becomes equal to or more than the first threshold value during printing the image by the printing unit.

3. The image output apparatus according to claim 1, wherein the printing unit is configured to print an image on the recording medium based on a print job, the image output apparatus further comprising:

a determining unit that determines whether it is possible to complete the print job in the first activation mode, wherein the switching unit switches the activation mode from the first activation mode to the second activation mode if the determining unit determines that it is not possible to complete the print job in the first activation mode.

4. The image output apparatus according to claim 2, wherein, in the second activation mode, the heating unit is activated at a heating temperature lower than that in the first activation mode.

5. The image output apparatus according to claim 1, wherein, in the second activation mode, a conveyance speed of the recording medium is smaller than that in the first activation mode.

6. The image output apparatus according to claim 1, wherein the printing unit is configured to print the image on the recording medium while conveying the recording medium, and wherein, in the second activation mode, a conveyance speed of the recording medium is slower than that in the first activation mode.

7. The image output apparatus according to claim 1, further comprising:

a display unit that notifies a user of information, wherein, in the second activation mode, power supply to the display unit is stopped or reduced.

8. An image output apparatus, which outputs an image, and which is activated in an activation mode including a first activation mode and a second activation mode that consumes less power than the first activation mode, the image output apparatus comprising:

a switching unit that selects one of the first activation mode and the second activation mode as the activation mode for activating the image output apparatus; and a storage unit that stores a total amount of power consumed on and after a reference time and a printing unit comprising an exposure unit, a transfer unit and heating and fixing unit so as to print the image on the recording medium electrophotographically, wherein the switching unit switches the activation mode from the first activation mode to the second activation mode based on an operation by a user when the amount of total power consumption stored in the storage unit is equal to or more than a first threshold value, wherein the activation mode further includes a third activation mode in which the heating unit is heated at a heating temperature lower than that in the second activation mode, and wherein the switching unit switches the activation mode from the second activation mode to the third activation mode when the amount of total power consumption is equal to or more than a second threshold value larger than the first threshold value.

9. An image output apparatus, which is configured to output an image on a recording medium, and which is activated in an activation mode including a first activation mode and a second activation mode that consumes less power than the first activation mode, the image output apparatus comprising:

a storage unit configured to store a total amount of power consumed on and after a reference time;

a receiving unit configured to receive a print job;

a first determining unit configured to determine whether it is possible to complete the print job in the first activation mode without the amount of total power consumption being equal to or more than a first threshold value;

a second determining unit which, if the first determining unit determines that it is not possible to complete the print job in the first activation mode, is configured to determine whether it is possible to complete the print job in the second activation mode without the amount of total power consumption being equal to or more than the first threshold value;

a switching unit configured to select one of the first activation mode and the second activation mode as the activation mode for activating the image output apparatus, wherein the switching unit is configured to:

switch the activation mode for activating the image output apparatus to the first activation mode if the first determining unit determines that it is possible to complete the print job in the first activation mode; and switch the activation mode for activating the image output apparatus to the second activation mode if the second determining unit determines that it is possible to complete the print job in the second activation mode; and a printing unit configured to print an image on the recording medium based on the print job in the activation mode selected by the switching unit, wherein the printing unit comprises an exposure unit, a transfer unit and a heating and fixing unit so as to print the image electrophotographically, wherein the activation mode further includes a third activation mode in which the heating unit is heated at a heating temperature lower than that in the second activation mode, and wherein the switching unit switches the activation mode from the second activation mode to the third activation mode when the amount of total power consumption is equal to or more than a second threshold value larger than the first threshold value.

10. The image output apparatus according to claim 9, wherein, in the second activation mode, the heating unit is activated at a heating temperature lower than that in the first activation mode.

* * * * *